United States Patent [19]

Thomassen et al.

[11] Patent Number: 4,773,978

[45] Date of Patent: Sep. 27, 1988

[54] APPARATUS FOR THE PRODUCTION OF METALS BY ELECTROLYSIS

[75] Inventors: Thomas Thomassen, Brekkestø; Trygve R. Jarlsby, Vågsbygd, both of Norway

[73] Assignee: Cheminor A/S, Norway

[21] Appl. No.: 16,386

[22] PCT Filed: Jan. 20, 1986

[86] PCT No.: PCT/NO86/00005

§ 371 Date: Jan. 29, 1987

§ 102(e) Date: Jan. 29, 1987

[87] PCT Pub. No.: WO87/00210

PCT Pub. Date: Jan. 15, 1987

[30] Foreign Application Priority Data

Jun. 27, 1985 [NO] Norway ..... 852594

[51] Int. Cl.[4] ..... C25D 17/00

[52] U.S. Cl. ..... 204/224 R; 254/10

[58] Field of Search ..... 204/10, 212, 257, 275, 204/224 R

[56] References Cited

U.S. PATENT DOCUMENTS

| | | | |
|---|---|---|---|
| 533,596 | 2/1895 | House | 204/10 |
| 1,959,376 | 5/1934 | Lucas | 204/10 |
| 3,002,898 | 10/1961 | Jarvis | 204/10 |
| 3,414,486 | 12/1968 | Nordblom et al. | 204/10 |
| 3,419,901 | 12/1968 | Nordblom et al. | 204/10 |
| 3,825,484 | 7/1974 | Fronsman et al. | 204/10 |

*Primary Examiner*—R. L. Andrews

*Attorney, Agent, or Firm*—Andrus, Sceales, Starke & Sawall

[57] ABSTRACT

An apparatus for extraction of metals by electrolysis comprising a means for applying a cathodic current of sufficient magnitude with respect to the cross-sectional dimension of an opening in an insulating coating on a cathode so that a powder-like deposit of anode metal will be made on exposed cathode metal, said deposited metal acting to decrease the current density so that subsequent deposited metal will be in a non-powder like consistency.

6 Claims, 5 Drawing Sheets

Fig. 3.
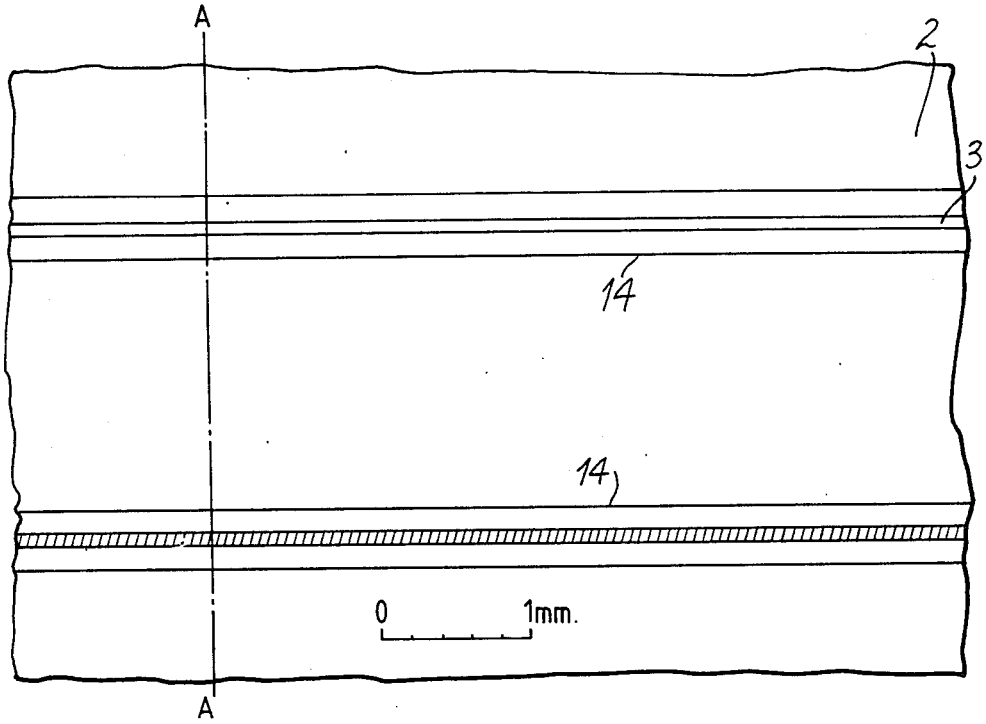
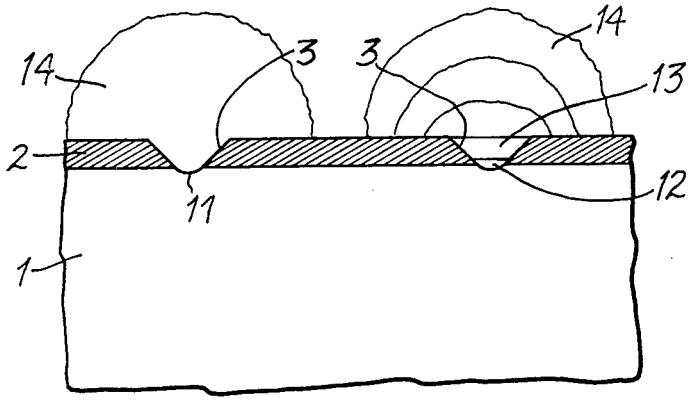
Fig. 8.

Fig. 4.
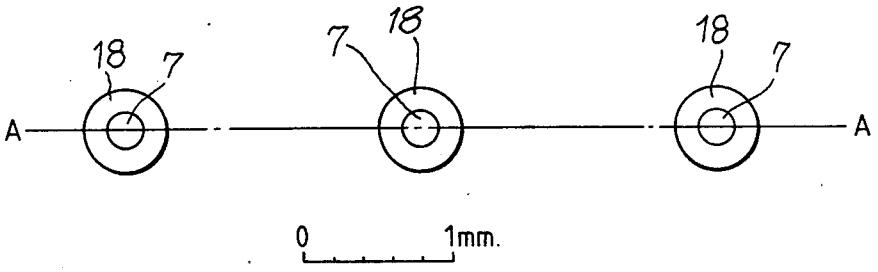
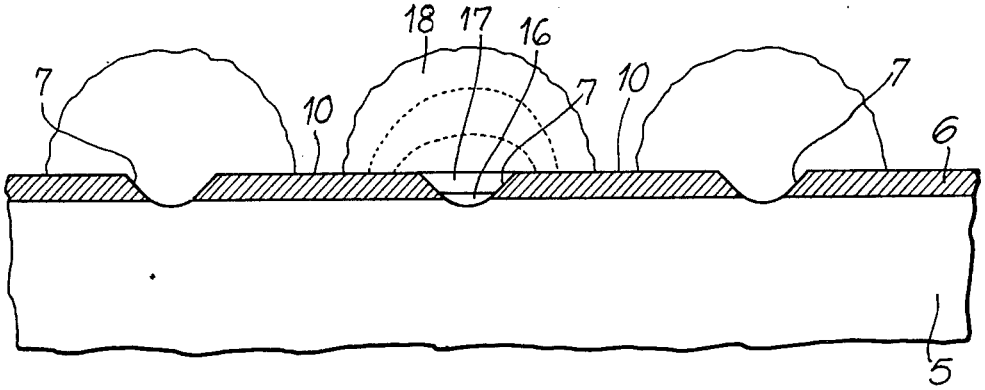
Fig. 9.

APPARATUS FOR THE PRODUCTION OF METALS BY ELECTROLYSIS

The present invention concerns a method for the production of metals by electrolysis from an aqueous electrolyte using at least one anode and at least one rotational cathode.

BACKGROUND OF THE INVENTION

The use of rotational plate cathodes is described in U.S. Pat. No. 1,073,868. The desired metal, here, precipitates onto the cathodes in the shape of a plate-like coating.

There has not been much practical use of rotational electrodes stationary plate cathodes being mainly in use to day.

The advantage of stationary plate cathodes lies in the simplicity of operation and relatively low maintenance costs. They are, however, quite dependent on manual handling in the tankhouse.

The first rotational cathodes, like the stationary plate cathodes, produced platelike cathodic deposits. The only difference was the geometry of the cathodes. The first mentioned were circular and the last mentioned rectangular. One of the reasons why rotational plate cathodes were not widely accepted may be the difficulties experienced in stripping the deposited metal from the cathodic material.

Development of the art of chemical processes during later years led to complete automation of all unit operations in an integrated process. In the case of electrolysis with stationary plate cathodes, partial automation is achieved by use of computors. The computors keep track of retention times of the cathodes in the electrolyte, and when the expected amount of metal is deposited, the computer will send an overhead crane to pick up the cathodes and move them to the stripping section. Then, the crane returns with a fresh mother plate cathode to the vacant place in the electrolytic tank.

Practical operation of such an automated electrolytic process is very complicated and many producers, thus, maintain old routines with manual labour operation.

In order to fully automate an electrolytic process, the concept of electrolysis must be changed to a new method maintaining the same metal quality as that obtained by the old methods, at the same costs, but permitting automation.

SUMMARY OF THE INVENTION

The present invention concerns a method that can be operated substantially continuously and automatic. This is achieved by use of at least one plate-shaped rotational cathode that is coated with an electrically insulating coat through which a number of electrical conductors are mounted. Each conductor serves as an area for deposition of the metal. Alternatively, the areas may be small holes made in the insulating coating.

When said areas are in the shape of holes in the insulating coating, it is a practical advantage to make said holes along a helical path with a mutual distance between holes of 0 to 5 mm. When this distance is 0 mm a continuous helical groove is made on the cathode. The deposited metal can, then, be withdrawn as a wire. If it is desirable to produce cathodes having such a helical groove, said groove may be cut using a sharp instrument that will cut through the insulating coating and expose the underlying elecroconductive core to the electrolyte.

DESCRIPTION OF THE PRIOR ART

As previously mentioned, an apparatus for electrolysis using rotational cathodes is known from U.S. Pat. No. 1,073,868. According to said patent the metal was deposited as a continuous coat onto the cathodes, and when the pre-set thickness was obtained said coat was stripped. This is an expensive and complicated process.

Furthermore, according to U.S. Pat. No. 3,860,509 an electrolytic cell is mounted inside a housing and comprises a flat rotational cathode spaced at a short distance from the corresponding anode. The shown cathode consists of a number of small diameter cathodic elements separated by an insulating matrix. Each element ends in a small tip onto which the metal may be deposited as a dendrite that can be scraped off using a mechanical device mounted on the facing anode surface. The scraper can be moved in a radial direction and the deposited dendrites on the cathode can, thus, be scraped off from said cathode and may sink to the bottom to be washed out together with the spent electrolyte when the latter is replaced by a fresh electrolyte. The dendrites are then separated from the electrolyte by a suitable method.

In U.S. Pat. No. 4,082,641 dealing with stationary plate cathodes comprising a number of electrical conductors separated by an insulating material, the electrolytic cell mentioned in U.S. Pat. No. 3,860,509 is discussed as follows: "This basic concept has been described in U.S. Pat. No. 3,860,509 where it has been used to generate fine, powder-like metals continuously on microscopic islands, but the technique disclosed therein is unsuitable for batch converser application where much larger deposits are involved". As mentioned here, the electrolysis cell of U.S. Pat. No. 3,860,509 is not suitable for industrial use. Additionally, the shown cell is too complicated for practical use.

In U.S. Pat. No. 4,025,400 a continuous process using stationary cathodes is disclosed, where the deposited metal is removed by use of "windscreen wiper"-like devices. The removed metal sinks down through the electrolyte onto a conveyor belt which transports the metal out of the cell. Such a method, as explained in the last mentioned U.S. patent, is relatively complex as a result of the use of mechanical scrapers used in a cell having a large number of alternating anodes and cathodes. Another complicating factor is the conveyor belt transporting the metal out of the cell.

According to the present method at least one rotating cathode is used. It is, advantageously, a circular plate. The cathodic material can, e.g. be of the kind described in U.S. Pat. No. 4,193,434, or it may be a metallic material onto which a non-conductive material is nailed in such a manner that a large number of nails/spikes having a diameter of up to 25 mm form the active cathode surface. Such a cathode can be manufactured in accordance with the method disclosed in the Norwegian patent application No. 85 0133 (Jan. 11, 1985).

Instead of producing the cathode in accordance with said NO patent application No. 85 0133, a cathode may be used where the precipitated metal is deposited in holes drilled in the insulating material, or in a helical groove made in the insulating material. A further, but less attractive, form of a groove is one extending radially towards the periphery. Generally speaking, the utilized cathode will comprise a number of electroconductive areas separated by an electrically insulating material.

DESCRIPTION OF THE DRAWINGS

The invention is in the following described with reference to the following figures, where FIG. 3 is an enlarged fragmentary plan view of the cathodic wheel of FIG. 1, FIG. 4 is an enlarged fragmentary plan view of the cathodic wheel of FIG. 2.

FIG. 8 is a section taken along line A—A of FIG. 3, and FIG. 9 is a section taken along line A—A of FIG. 4.

DESCRIPTION OF THE ILLUSTRATED EMBODIMENT

Figure 1:
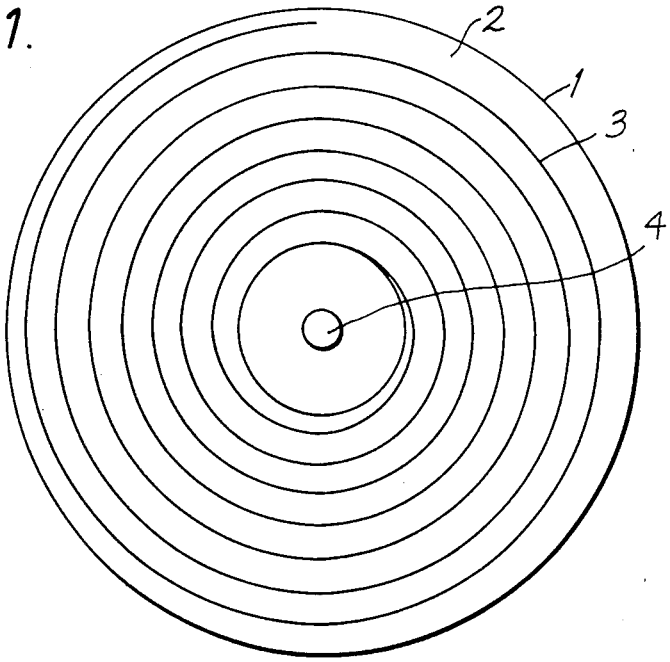
FIG. 1 is a plan view of a cathodic wheel used in accordance with the present method.

FIG. 1 shows a cathodic wheel 1 having an insulating coating 2. 3 is an electroconductive helical groove area. (Only one groove is shown here.) 4 is the hole in the wheel for the shaft. This wheel produces wire.

Figure 2:
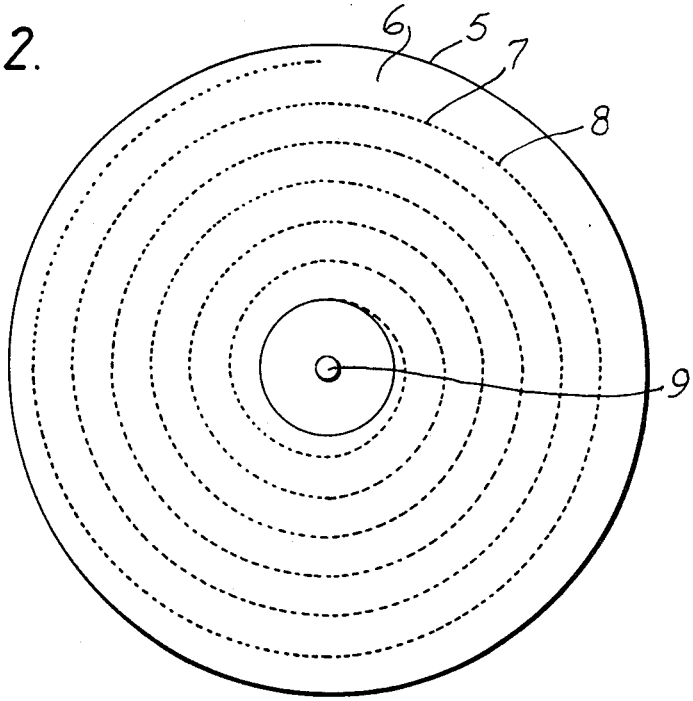
FIG. 2 is a plan view of another embodiment of cathodic wheel used in accordance with the present method.

FIG. 2 shows a cathodic wheel 5 having an insulating coating 6. A plurality of holes 7 are drilled along a helical path 8. 9 is a hole in the wheel for the shaft. 10 is the insulating portion between each hole. This wheel produces prills.

As shown in FIG. 3 groove 3 is made in the insulating coating 2. The bottom of the groove is naked metal 11. FIG. 8 is a cross section of the wire made in the groove 3. 12 shows where the first metal is deposited which has a "rotten" texture. (8) shows the zone where "brittle" metal is located whereas (9) indicates the zone where solid metal is located.

FIG. 4 shows the helical path along which holes 7 are drilled in the insulating coating 6, and 15 indicates the conductive metal bottom in the hole 7.

FIG. 9 shows a section of a prill, where 16 is the "rotten" zone first deposited at a very high current density. 17 shows the brittle zone, and 18 shows the zone where the solid metal is deposited.

Figure 5:
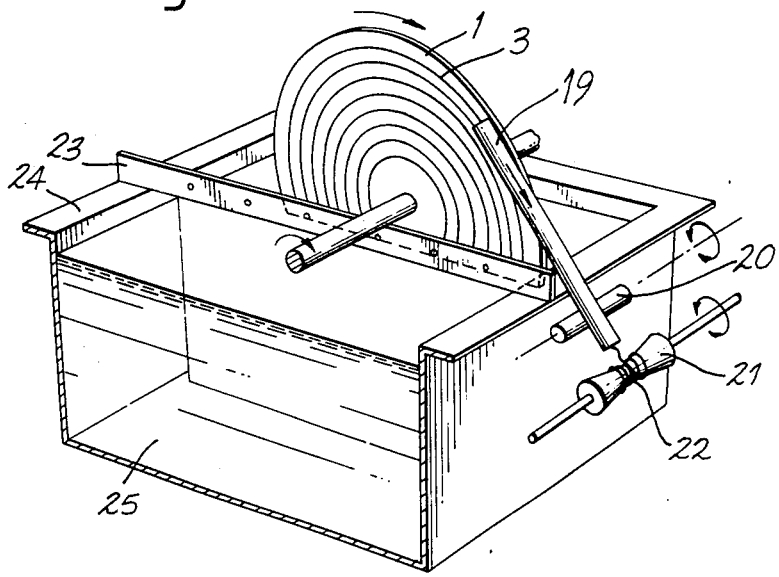
FIG. 5 is a perspective view of a part of an electrolytic apparatus, where the cathodic wheel in use is provided with a helical groove.

FIG. 5 shows the cathodic wheel of FIG. 1, where the metal is formed in the helical groove 3. 19 is the wire remover (cropper, harvester) controlled by 120. The wire taken off is wound by 21 and a bundle 22 can be removed. 23 is the anode, and 24 is the tank with an electrolyte 25.

Figure 6:
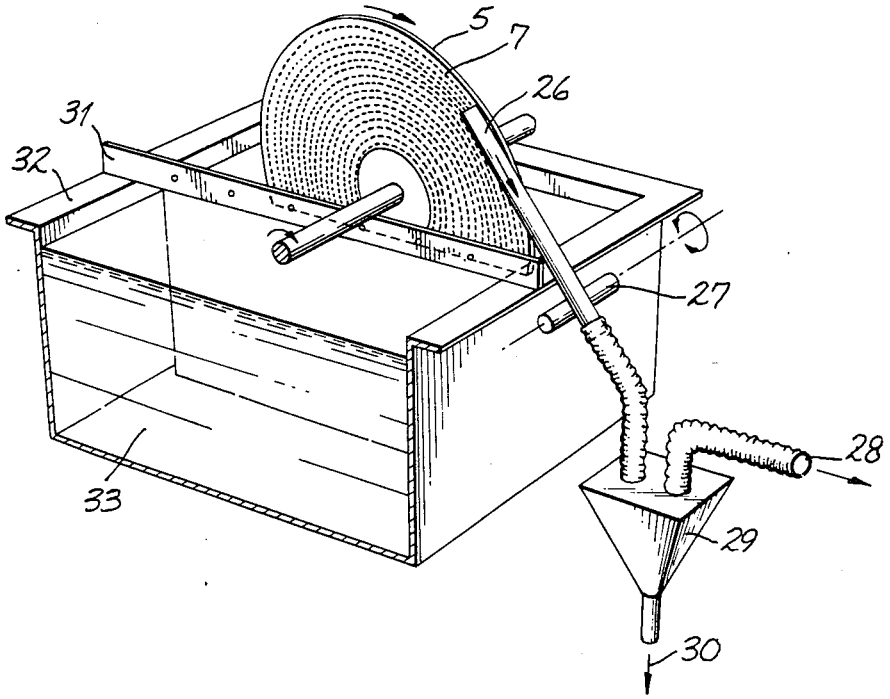
FIG. 6 shows a similar arrangement to that of FIG. 5, the cathodic wheel, here, being provided with a number of holes drilled along a helical path.

FIG. 6 shows the cathodic wheel of FIG. 2, where (2) indicates holes drilled along a helical path, as shown in FIG. 2. 26 designates the prill remover (cropper, harvester) which is controlled by 27. The prills are sucked by a suction system 28 down into hopper 29 and are discharged into conduit 30. 32 is an anode in a tank 32 containing an electrolyte 33.

Figure 7:
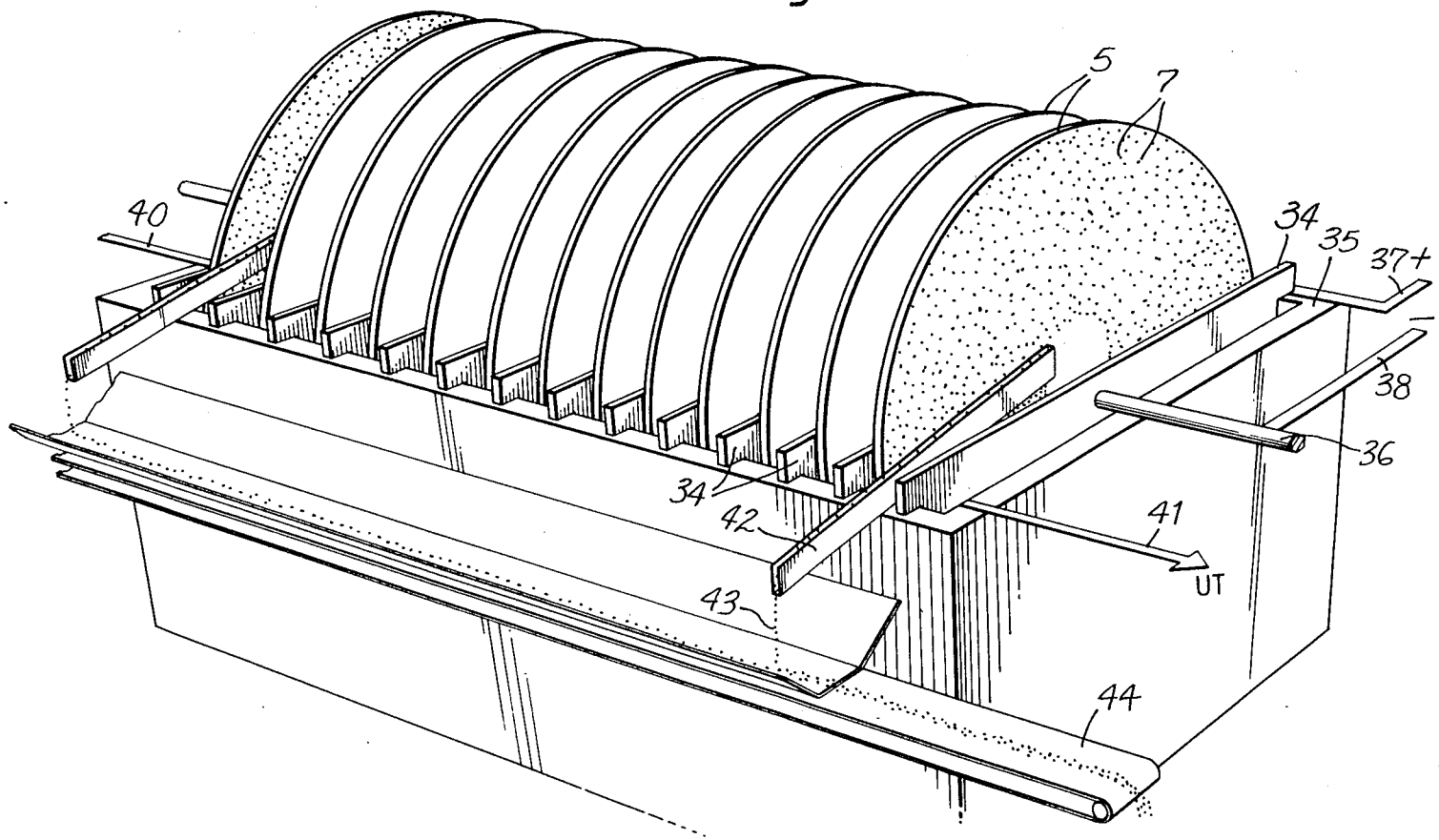
FIG. 7 is a perspective view of a an electrolytic cell comprising a number of anodes and cathodes. In the figure, only cathodes having a number of holes drilled in the electrically insulating coating are shown with an additional removing device for removing the deposited metal different from that shown in FIG. 5.

In FIG. 7 a group of rotating plate cathodes such as 5 are arranged alternately with anodes 34 in a tank 35. Cathode 5 is provided with a number of electroconductive areas 7 separated by an electrically insulating material. Such a cathode, thus, represents one of the previously disclosed cathodic materials. The plate cathodes are mounted on a rotating shaft 36.

The anodes and cathodes are connected to (not shown) an external power supply via current bus-bars 37 and 38 respectively. The electrolyte is added to the tank 35 through a supply pipe or conduit 40 and spent electrolyte is removed from tank 35 through a corresponding pipe or conduit 41. The metal deposited on the cathodes is removed by use of mechanical scraper 42 and the removed metal 43 falls down onto a conveyor 44 and is removed from the system. In the figure only one scraper on one side of cathode 1 is shown, whereas in practice, of course, a scraper on each side of each rotating cathode 1 will be used.

When a helical groove 3 is cut in the cathodic coating it is, preferably, made in such a manner that the width of the conductive metal bottom of the groove is in the range of 0.05–0.2 mm. When holes 7 are drilled in the insulating coating on the cathode, the metallic bottom of the hole, preferably, has a diamter in the range of 0.1–0.5 mm for the production of prills.

Persons skilled in the art of electrolysis will know that different metals deposited by electrolysis will show varying rigidity and hardness. A hard and brittle metal may, advantageously, be deposited as prills, and a soft metal may, advantageously, be deposited as a wire by using a cathode with a helical groove cut into it.

The present method will be further described by the following examples.

EXAMPLE 1

The object of this example was to prove that copper prills can be made by electrolysis in a standard $CuSO_4/H_2SO_4$ electrolyte using a rotating cathode coated with a plastic coating into which a number of holes had been made, thus, exposing the underlying cathode metal to the electrolyte through said holes.

Test conditions were as follows:

| | 8 |
|---|---|
| Rotation of cathode | 2 rpm |
| Temperature | 40° C. |
| Anode | Copper |
| Cathode | Plastic coated stainless stell plate having 200 holes with diameter 0,5 mm. Cathode diameter = 200 mm. |
| Current | 0,2 amps at start<br>4,5 amps at the end |
| Cell voltage | 0,3 volts |
| Submersion of cathode in the electrolyte | 45% of total cathodic area. |

Table 1 - Results

| Time (hrs) | Average prill weight (mg) | Average prill diam. (mm) |
|---|---|---|
| 17.7 | 42 | 2,7 |

The test shows that almost perfect semi-spherical prills of copper were produced in a size that could easily be stripped off after 17.5 hours of electrolysis. The prills were solid and could easily be washed to remove traces of electrolyte.

The electrolytic cell was operated on a constant cell voltage of 0.3 volts, thus, varying the current density in accordance with the size of the prills produced.

In practice an even current distribution is expected and hence a constant cell current and voltage, this because several cathodes will be utilized in a cell and only some of the cathode sides will be stripped at any given period of time.

EXAMPLE 2

The object of this example was to show that prills are also formed when the diameter of the hole exposed to the electrolyte (hereafter called "island") was larger than 0.5 mm. The diameter was varied from 0.5 to 4.5 mm, but the test was carried out as in example 1 for the rest.

TABLE 2

| | | Results | | | |
|---|---|---|---|---|---|
| Time | Island diam. (mm) | Average prill diam. (mm) | Average prill weight (mg) | Theoretical weight (mg) | F |
| 17.5 | 0,5 | 2.7 | 42 (ex.1) | 44 | 0.95 |
| 50 | 1.5 | 5.0 | 270 | 280 | 0.96 |
| 33 | 2.5 | 5.0 | 260 | 280 | 0.93 |
| 80 | 4.5 | 8.0 | 650 | 1140 | 0.57 |

F = a factor showing the ratio between the weight of the deposited prill and the weight of a perfect semispherical ball having the same diameter as the deposited prill.

The test shows that the prills produced were almost perfect semi-spherical balls when the island diameter was less than 2.5 mm. The semi-spherical prills were easier to strip off than prills made on islands having a diameter of more than 2.5 mm. This indicates that it is advantageous, in practical operation, to use islands having a diameter of less than 2.5 mm.

EXAMPLE 3

This example was carried out to show the advantage of using rotational cathodes as compared to stationary plate cathodes. A zinc anode was used in a zinc chloride electrolyte. The cathode was a rotational aluminium plate coated with a 2 mm thick plastic plate nailed to the aluminium core by use of aluminium nails. It was, in other words, produced in accordance with NO patent application No. 85 0133. The heads of the nails served as islands, and during electrolysis zinc was deposited on said islands. The diameter of said islands was 4.5 mm and the temperature was 32.5° C. The electrolyte contained 25 g/l $Zn^{++}$ and the pH was adjusted to 2 using HCl. No organic polymers were added.

TABLE 3

| | | Results | |
|---|---|---|---|
| Time (hrs) | RPM | Current eff. (%) | Energy used (kwh/ton Zn) |
| 24 | 0 | 75.2 | 1210 |
| 32 | 1 | 98.4 | 600 |
| 22 | 2 | 95.2 | 630 |
| 23 | 6 | 91.3 | 670 |

The zinc prills were flat but easy to strip off from the cathode. The current was almost constant at 1.0–1.3 amps with a cell voltage of 0.6–0.8.

The test clearly indicates that it is advantageous to use rotational cathodes in the present method, the rotational cathode causing good stirring of the electrolyte in the tank and, thereby, decreasing or eliminating the diffusional zones along the cathode caused by the hydrogen bubbles, as well as denudation of the electrolyte w.r.t. zinc ions.

EXAMPLE 4

The object of this test was to produce wire instead of prills of copper.

A circular cathode wheel was made from stainless steel with a diameter of 1.0 meter and was coated with an epoxy resin. On one side, a helical groove was cut in the epoxy resin down to the underlying metal in such a manner that the bottom of the groove was a 0.2 mm wide metal band having a length equal to the entire length of the groove. The helical groove had a pitch of 5 mm, so that the total length of the spiral was 140 meters, starting from the cathode's outside (D=0.98 m) to an inner diameter of 0.25 meters.

Said wheel was submerged in a standard copper electrolyte to 40% of the total cathode surface, and the current flow was started. After 35 hours of electrolysis at 17 amperes, 610 g of copper-wire were stripped from the wheel portion above said electrolyte. This wire had a diameter of about 1.0 mm and a cross-section almost perfectrly semi-circular.

| Test data | |
|---|---|
| Anode | Lead (3% Sb stabilized) |
| Cathode | Stainless steel, epoxy resin coated on both sides. |
| Electrolyte | Copper sulphate/sulphuric acid (60 g/l Cu, 100 g/l $H_2SO_4$) |
| Temperature | 79° C. |
| Cell voltage | 1.66 V (at the end) |

CONCLUSIONS

The initial current density was so high that the bottom of the wire (the metal first deposited in the groove) was "rotten" and appeared as a dark powder. As the wire grew current density was decreased towards 1.7 $A/dm^2$. This produced a solid, shining metal wire. Stripping of said wire was very easy due to the "rotten" core made initially. This method of electrolysis is intentional and a preferred method in accordance with the present invention.

Stripping was performed using a "pick-up" which was provided with a small stainless steel knife on the end. Said "pick-up" was a hollow tube connected to a spooling arrangement. The wire loosened by the knife was easily transported down the tube to the spooler where a coil was made of the wire produced. The "pick-up" easily followed the helically formed wire on the cathode.

EXAMPLE 5

The object of this test was to make nickel prills.

A circular cathode wheel made from stainless steel and having a diameter of 1.0 m was coated with an epoxy resin. On one side 17 500 holes were drilled in such a manner that the bottom of the holes exposed the underlying metal core. The diameter of this metallic bottom was 0.2 mm. Said holes were drilled sequencially along a helical path 8 mm apart. The pitch of said path was 5 mm, the total length of said helical path, thus, being 140 m, starting from the cathode outside (D=0.98 m) to an inner diameter of 0.25 m.

| Test data | |
|---|---|
| Cathode | Stainless steel, epoxy resin coated on both sides |
| Anode | Ruthenium coated titanium |
| Electrolyte | Nickel sulphate/-chloride (Ni = 60 g/l, pH = 1.3–1.5) |
| Temperature | 77° C. |
| Cell voltage | 2.12 V (at the end) |

CONCLUSIONS

After 32 hours of electrolysis at a constant current of 17 amps, 530 grams of nickel prills were easily stripped from the cathode wheel.

The initial current density was so high that the bottom of prills (the metal initially deposited in the drilled holes) was "rotten" and consisted of a dark powder.

As the prills grew current density decreased towards 2.5 A/dm$^2$. This produced solid and shining metal prills. Stripping the prills was very easy due to the "rotten" core initially formed. This procedure is ententional and a preferred method in accordance with this invention, both as regards wire and prills.

Stripping was performed using a "pick-up" provided with a small stainless steel knife at the end. The "pick-up" was a hollow tube connected to a suction system and a cyclone. The prills loosened by the knife were easily and efficiently sucked into said "pick-up" and then down into the cyclone, from which they were discharged after ended stripping. The "pick-up" easily followed the helical path made by the prills.

This shows that the present invention is flexible encompassing a cathode having at least one continuous grove/side to a cathode having its groove divided into smaller portions (holes) and, thus, producing prills instead of wire.

EXAMPLE 6

The object of this test was to produce nickel wire. The electrolyte and the procedure from example 5 were used, but the cathodic wheel was replaced by one as used in example 4.

After ended electrolysis the nickel wire produced was stripped off and spooled to a coil as mentioned in example 4. This shows that the present invention is also flexible so as to encompass production of nickel wire.

It was found that the cathode in the pilot plant could be submerged to between 30 to 70% of its total surface area into the used electrolyte.

We claim:

1. An apparatus for extraction of metals by electrolysis, comprising a bath to contain an electrolytic solution, a metal plate-like cathode having a substantially flat surface, an anode formed of a material to be deposited and connected electrically to said cathode in a cathodic circuit, means for rotating said cathode in said bath, an insulating coating disposed on said surface, said coating having at least one opening to expose the cathode to said solution, means for applying a current to the cathodic circuit with said current being of sufficient magnitude with respect to the cross-sectional dimension of said opening so that a powder-like deposit of said anode metal will be made on the exposed cathode, said deposited metal acting to decrease the current density so that subsequent deposited metal will be in a nonpowder-like consistency.

2. The apparatus of claim 1, wherein said opening comprises a multiplicity of spaced holes.

3. The apparatus of claim 1, wherein said opening comprises a helical groove.

4. The apparatus of claim 1, wherein the opening is generally V-shaped in cross section and is bordered by spaced, outwardly diverging walls.

5. A method for the electrodeposition of a metal, comprising the steps of applying an insulating coating to a generally flat surface of a plate-like cathode, forming at least one opening in said insulating coating, positioning said cathode in an electrolytic bath, connecting the cathode in a cathodic circuit with an anode of a metal to be plated, rotating said cathode in said bath, applying a current of sufficient magnitude with respect to the area of said opening to provide an initial current density of a magnitude to form a powder-like deposition of said anode metal at the exposed portion of said cathode, and thereafter reducing the current density to form an outer deposited portion of said anode metal in a nonpowder-like consistency.

6. The method of claim 5, wherein current is applied in a manner such that the deposited metal has a progressively greater surface area in a direction outward of said cathode.

* * * * *